US007898179B2

(12) United States Patent
Bourgery et al.

(10) Patent No.: US 7,898,179 B2
(45) Date of Patent: Mar. 1, 2011

(54) DISCHARGE LAMP EXHIBITING REDUCED THERMAL STRESS AND METHOD OF MAKING SUCH A LAMP

(75) Inventors: Matthew A. Bourgery, Concord, NH (US); Paul H. Townsend, Amesbury, MA (US); Chung-Yao Chao, Lincoln, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 142 days.

(21) Appl. No.: 12/082,987

(22) Filed: Apr. 16, 2008

(65) Prior Publication Data

US 2009/0261729 A1 Oct. 22, 2009

(51) Int. Cl.
*H01J 17/16* (2006.01)
*H01J 61/30* (2006.01)

(52) U.S. Cl. ..... 313/623; 313/634

(58) Field of Classification Search ..... None
See application file for complete search history.

(56) References Cited

U.S. PATENT DOCUMENTS 3,290,773 A * 12/1966 Wohlberg et al. ..... 219/137 R
3,996,487 A * 12/1976 Hoeh ..... 313/25
4,020,379 A * 4/1977 Manning ..... 313/600
4,584,454 A * 4/1986 Feuersanger et al. ..... 219/118
4,737,677 A * 4/1988 Whitten ..... 313/25
5,300,753 A * 4/1994 Rossi ..... 219/110
2002/0070644 A1 * 6/2002 Dakin et al. ..... 313/25

OTHER PUBLICATIONS

AK Steel Corporation, "Product Data Sheet, 430 Stainless Steel, UNS S43000", 430-S-8-01-07, 2007.*
van Vliet, J.A.J.M., de Groot, J.J., "High-Pressure Sodium Discharge Lamps", in Physical Science, Measurement and Instrumentation, Management and Education, Reviews, IEE Proceedings, vol. 128, Pt. A, No. 6 (Sep. 1981) pp. 415-441 (ISSn: 0143-702X).

* cited by examiner

*Primary Examiner* — Toan Ton
*Assistant Examiner* — Britt D Hanley
(74) *Attorney, Agent, or Firm* — Edward S. Podszus

(57) ABSTRACT

A lamp (100) comprises an outer envelope (120) having first and second electrical lead-ins (140, 160) sealed into a base (180) of the envelope (120). A ceramic arc tube (200) is operatively mounted within the envelope (120), the arc tube (200) having at least one electrode (220) therein. A tubular, niobium feed-through (240) is connected to the at least one electrode (220) and sealed to the ceramic body (120) at a joint (260) that can comprise a glass frit (260*a*). A stainless steel rod (280) is electrically connected between the electrical lead-in (140) and the tubular niobium feed-through (240), the stainless steel rod (280) being the only electrical connection between the lead-in (140) and the niobium feed-through (240).

6 Claims, 2 Drawing Sheets

DISCHARGE LAMP EXHIBITING REDUCED THERMAL STRESS AND METHOD OF MAKING SUCH A LAMP

TECHNICAL FIELD

This invention relates to discharge lamp. More particularly it relates to discharge lamps having ceramic arc tubes and still more particularly it relates to high pressure sodium discharge lamps.

BACKGROUND ART

Discharge lamps, such as the afore-mentioned sodium lamps, are staple articles of commerce. The lamps comprise a ceramic arc tube mounted in a vitreous envelope and various electrical lead-ins to conduct current to the arc tube electrodes. Because of the different materials used, such as the ceramic arc tube and various metallic components and their differing thermal expansion coefficients (TEC), many compromises have to be made to ensure economic manufacturing costs, reasonable light output and reasonable life expectancy. Anytime any of these contingencies can be enhanced or improved, a decided advance in the art is achieved. For example, in high pressure sodium lamps it has been necessary to provide an auxiliary, U-shaped, current-carrying niobium wire welded between a niobium component and a nickel-plated steel (NPS) support attached to a lead-in at one end and the niobium feed-through at the other end. The U-shaped niobium wire was necessary because, while niobium provides a close TEC with the ceramic (usually, alumina), its TEC is far removed from most other metals. This creates a large thermal strain at the weld joint of the niobium component and NPS support rod. The U-shaped niobium wire, or U-bend, places the weld joint farther away from the heat generated by the operating arc tube and reduces the thermal strain on the niobium-NPS juncture. However, while this technique worked successfully, it added parts and cost to the lamp. Further, it would be an advance in the art to eliminate the NPS support because the nickel plating process is not environmentally friendly and, as fewer and fewer companies undertake its manufacture, its cost has greatly increased.

DISCLOSURE OF INVENTION

It is, therefore, an object of the invention to obviate disadvantages in the prior art.

It is another object of the to enhance discharge lamps.

Yet another object of the invention is to improve discharge lamps.

These objects are accomplished, in one aspect of the invention, by the provision of a discharge lamp comprising: an outer envelope; first and second electrical lead-ins sealed into the base of the envelope; a ceramic arc tube operatively mounted within the envelope, the arc tube having at least one electrode therein; a tubular, niobium feed-through connected to the at least one electrode and sealed to the ceramic body; and a stainless steel rod electrically connected between a first of the electrical lead-ins and the tubular niobium feed-through, the stainless steel rod being the only electrical connection between the lead-in and the niobium feed-through. The difficulty of achieving a good, long-lasting weld between the niobium and the stainless steel (necessary because a suitable stainless steel, such as 430SS, has a lower thermal conductivity and higher electrical resistance then the previously employed NPS) is surmounted by a new welding method that involves adding an argon shield gas to the welding station.

The elimination of what was previously considered to be an indispensable component has reduced the cost of the lamp and the consummation of a better connection with a more suitable support structure has greatly enhanced and improved the lamp.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
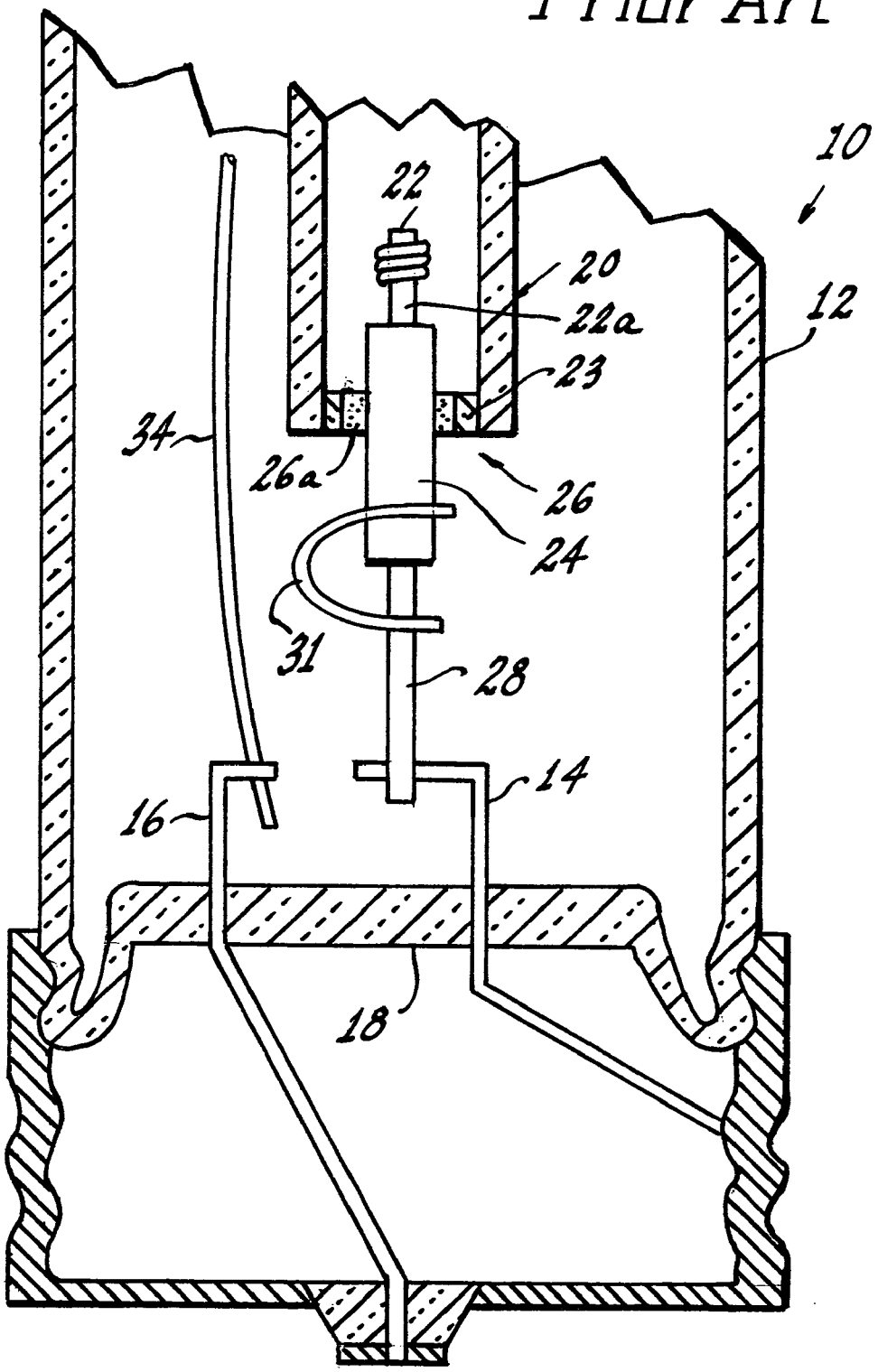
Fig. 1 Prior Art
FIG. 1 is a diagrammatic, sectional view of a prior art lamp.

Referring now to the drawings with greater particularity, there is shown in FIG. 1 a prior art high pressure sodium lamp 10 having a vitreous outer envelope 12. Lead-ins 14, 16 are sealed into the base 18 of the envelope. A ceramic arc tube 20, for example, one constructed of polycrystalline alumina, is mounted in the outer envelope 12. Electrodes 22 (only one of which is shown) are sealed into opposite ends of the arc tube 20 by known techniques. For example, the electrode 22 can be a tungsten rod 22*a* sealed into a niobium tube 24. The niobium tube 24 is itself hermetically sealed into a ceramic endcap 23 by a joint 26 that comprises a glass frit 26*a*. A support rod 28, such as one of NPS, is fitted into the niobium tube 24 at one end and has its other end fixed to one of the lead-ins, for example, 14. A U-bend 31, which comprises a niobium wire, has one end welded to the niobium tube 24 and a second end welded to the support rod 28. The U-bend 31 is a current-carrying member that places the weld joint farther away from the heat generated by the operating arc tube 20 and reduces the thermal strain on the niobium-NPS juncture.

Figure 2:
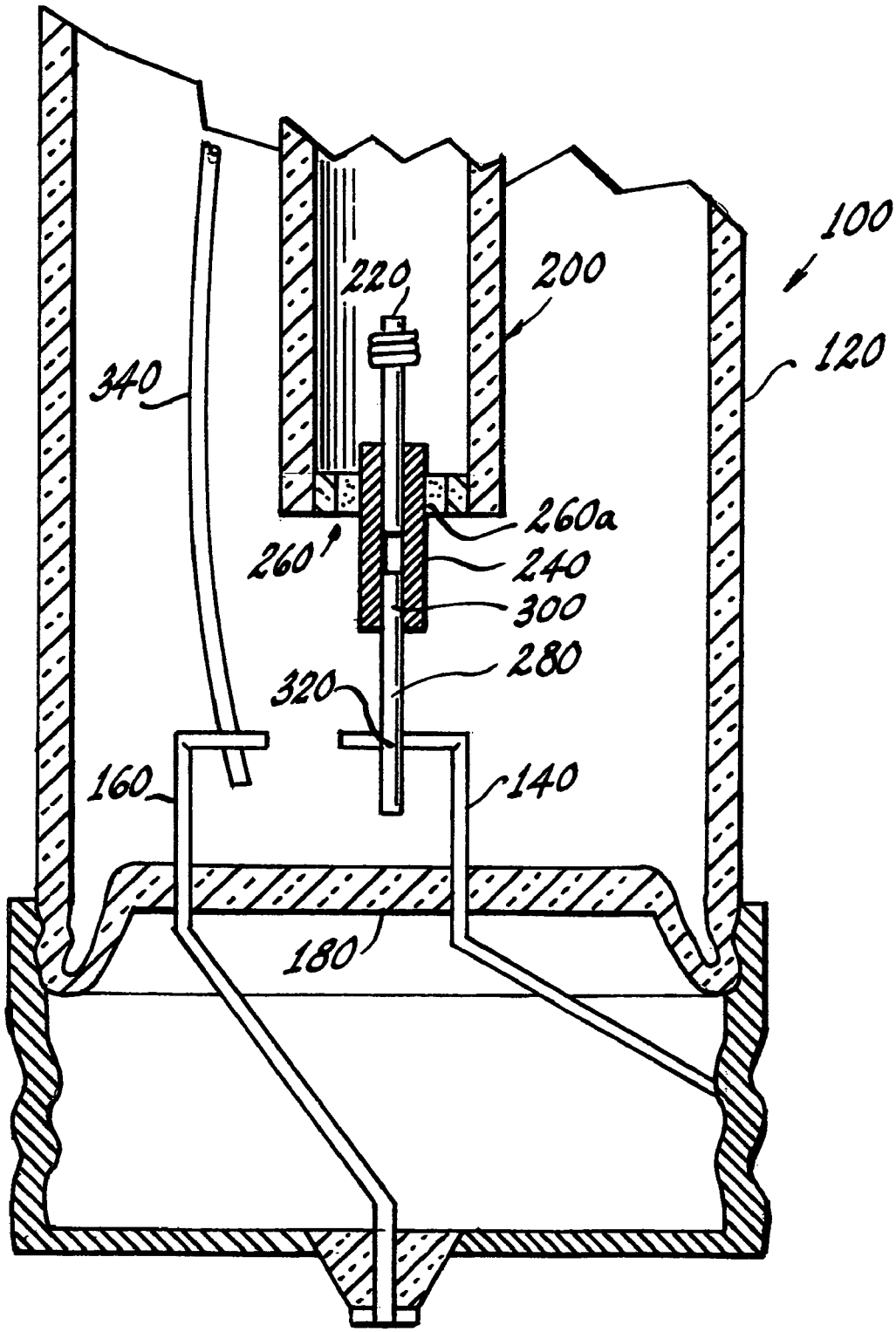
FIG. 2 is a similar view of a preferred embodiment of the invention.

Referring now to FIG. 2 there is shown a discharge lamp 100 in accordance with an embodiment of the invention. The lamp 100 comprises an outer envelope 120 having first and second electrical lead-ins 140, 160 sealed into a base 180 of the envelope 120. A ceramic arc tube 200 is operatively mounted within the envelope 120, the arc tube 200 having at least one electrode 220 therein. A tubular, niobium feed-through 240 is connected to the at least one electrode 220 and sealed to the ceramic body 120 at a joint 260 that can comprise a glass frit 260*a*. A stainless steel rod 280 is electrically connected between the electrical lead-in 140 and the tubular niobium feed-through 240, the stainless steel rod 280 being the only electrical connection between the lead-in 140 and the niobium feed-through 240. In a preferred embodiment of the invention, the stainless steel rod is comprised of 430SS, a composition of 84% iron and 16% chromium and has an end 300 enclosed within the niobium tube 240 and a second end 320 attached to lead-in 140. A second current-carrying element 340 is attached to the second lead-in 160 and connects to the second electrode, which is not shown.

To accomplish the weld between the niobium tube 240 and the stainless steel rod 280 it is necessary to reduce excessive heating and oxidation of the niobium tube during the welding process and this is accomplished adding an argon gas shield to the welding station. A suitable flow rate for the argon is 2 scfh. Further, if pulse welding is used, it has been found desirable to reduce the welding current from 1.7 KA to 1.2 KA in the second pulse. This helps to prevent the niobium from overheating.

A second technique for removing excess heat comprises using a large chill-block as the grounding electrode at the welding station. Any other technique which adequately draws heat away from the welding station is also within the purview of the invention.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A discharge lamp comprising:

an outer envelope;

first and second electrical lead-ins sealed into the base of the envelope;

a ceramic arc tube operatively mounted within the envelope, the arc tube having at least one electrode therein;

a tubular, niobium feed-through connected to the at least one electrode and sealed to the ceramic body; and a stainless steel rod electrically connected between the first of the electrical lead-ins and the tubular niobium feed-through, the stainless steel rod being partially disposed within the tubular niobium feed-through, a weldment formed at an interface between the stainless steel rod and the tubular niobium feed-through, and the stainless steel rod being the only electrical connection between the lead-in and the niobium feed-through.

2. The discharge lamp of claim 1 wherein the lamp is a high pressure sodium lamp.

3. The lamp of claim 1 wherein the stainless steel rod has one end enclosed within the tubular niobium feed-through.

4. The lamp of claim 1 wherein the stainless steel rod comprises 84% iron and 16% chromium.

5. A method of making an electrode feed-through composite comprising the steps of:

forming a tubular component of the feed-through composite of a first material comprising niobium;

forming a solid component of the feed-through composite of a second material comprising stainless steel;

positioning the tubular component of the feed-through composite at a welding station;

positioning the solid component of the feed-through composite at the welding station;

inserting one end of the solid component into an end of the tubular component;

flooding the welding station with argon; and consummating a weld between the tubular component and the solid component.

6. A method of making an electrode feed-through composite comprising the steps of:

forming a tubular component of the feed-through composite of a first material comprising niobium;

forming a solid component of the feed-through composite of a second material comprising stainless steel;

positioning the tubular component of the feed-through composite at a welding station in physical contact with an electrically grounded chill-block;

positioning the solid component of the feed-through composite at the welding station;

inserting one end of the solid component into an end of the tubular component; and consummating a weld between the tubular component and the solid component.

* * * * *